US011691410B2

(12) United States Patent
Vodoz et al.

(10) Patent No.: US 11,691,410 B2
(45) Date of Patent: Jul. 4, 2023

(54) HOT FOIL STAMPING PRESS

(71) Applicant: BOBST MEX SA, Mex (CH)

(72) Inventors: Roland Vodoz, Yverdon-les-Bains (CH); David Gentil, L'Auberson (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 17/806,591

(22) Filed: Jun. 13, 2022

(65) Prior Publication Data

US 2023/0001686 A1 Jan. 5, 2023

(30) Foreign Application Priority Data

Jul. 1, 2021 (EP) ..... 21183041

(51) Int. Cl.
*B41F 16/00* (2006.01)
*B41F 1/38* (2006.01)

(52) U.S. Cl.
CPC ..... *B41F 16/006* (2013.01); *B41F 1/38* (2013.01); *B41F 16/0006* (2013.01)

(58) Field of Classification Search
CPC ..... B41F 16/006; B41F 16/0006; B41F 1/14; B41F 1/02; B41F 1/04; B41F 1/38; B65H 75/4471; B65H 75/4457; B41P 2219/00
See application file for complete search history.

(56) References Cited

U.S. PATENT DOCUMENTS 5,273,326 A * 12/1993 Kinkaide ..... E05C 17/04 292/DIG. 38
2014/0020575 A1* 1/2014 Chretien ..... B30B 15/064 101/27
2015/0283776 A1* 10/2015 Robinson ..... B41F 16/02 156/367
2022/0040947 A1* 2/2022 Mombourquette ..... B30B 1/04
2022/0184935 A1* 6/2022 De Gaillande ..... B41F 16/006

FOREIGN PATENT DOCUMENTS

GB 2519538 A * 4/2015 ..... B41M 5/0358
WO 2020186470 A1 9/2020

* cited by examiner

*Primary Examiner* — Yaovi M Ameh
*Assistant Examiner* — Quang X Nguyen
(74) *Attorney, Agent, or Firm* — Bookoff McAndrews, PLLC

(57) ABSTRACT

A hot foil stamping press (10) comprises a platen press (16), with a supporting plate (22) comprising a base plate (26) and a compensating plate (28) being rotatably attached to the base plate (26) for switching between an operating position and a makeready position and a hook element (38) comprising a base part and a top part being arranged at an angle relative to the base part. The hook element (38) is rotatably attached to a door (30) of the platen press (16) by a fixation axle for switching between a releasing position and a securing position of the hook element, wherein the top part retains the compensating plate (28) in its makeready position when the hook element (38) is in its securing position.

10 Claims, 4 Drawing Sheets

HOT FOIL STAMPING PRESS

CROSS-REFERENCE TO RELATED APPLICATION(S)

This patent application claims the benefit of priority to European Application No. 21183041.9, filed on Jul. 1, 2021, the entirety of which is incorporated herein by reference.

The invention relates to a hot foil stamping press comprising a platen press.

Hot foil stamping is a method for transferring patterns and texts from a foil onto a sheet at high temperatures. The sheet can be cardboard or paper, and the foil is either a metallized plastic foil or a thin metal foil. Typically, the foil is pressed onto the surface of the sheet so that part of the foil is transferred to the sheet where it adheres.

A platen press comprises an upper and a lower platen. On the lower platen, a supporting plate is installed to perform the hot stamping of the foil. For achieving the desired pressure during the hot stamping process, the thickness of the supporting plate must be set with a precision to a few tens of microns.

To this end, the supporting plate can be made of two pieces, a lower base part and a top plate, called the compensating plate. Between the base part and a top plate, a so-called "makeready sheet" is placed at selected locations to control and/or set the pressure at each location of the whole surface of the platen. The compensating plate is lifted and kept in a lifted position to allow an operator to install the makeready sheet.

In known hot foil stamping presses, the supporting plate must be removed from the platen press completely such that the top plate can be lifted to be in a vertical position during installation of the makeready sheet. However, such a setup requires a considerable amount of space in front of the platen press which is undesirable due to space constraints. This effect is especially problematic in case of so called cross-foil stamping presses, like the one shown in WO 2020/186470 A1, which require additional parts of the hot foil stamping press to extend towards an operator side of the press.

It is an object of the invention to provide a hot foil stamping press with reduced space requirements. Preferably, the hot foil stamping press should provide for an easy and fast set-up procedure.

The object of the invention is solved by a hot foil stamping press comprising a platen press, with a supporting plate comprising a base plate and a compensating plate being rotatably attached to the base plate for switching between an operating position and a makeready position and a hook element comprising a base part and a top part being arranged at an angle relative to the base part. The hook element is rotatably attached to a door of the platen press by a fixation axle for switching between a releasing position and a securing position of the hook element, wherein the top part retains the compensating plate in its makeready position when the hook element is in its securing position.

A basic idea of the invention is that the top part of the supporting plate can easily be secured in its makeready position by the hook element provided at a door of the platen press. This allows a flexible arrangement of the top part in its makeready position relative to the base plate. Especially, the top part is not restricted to be brought into a vertical position, thereby allowing to optimize the makeready position in regard to the available space in front of the platen press.

The door is arranged at an operator side (OS) of the platen press to allow an operator of the hot foil stamping press to easily access the supporting plate and the hook element during setup of the supporting plate.

In the makeready position, the compensating plate is arranged close to the door of the platen press for interaction with the hook element. E.g., the compensating plate is arranged essentially parallel or at an angle relative to the door.

The expression "at an angle" means that there is an angle between the respective parts which is in the range between 0° and 180°, i.e. not equal to 0° or 180°.

The hot foil stamping press is preferably a cross-foil stamping press.

To ensure a reliable interaction between the hook element and the compensating plate, the hook element can be held in its securing position by an elastic element.

E.g., the elastic element is a spring, which preferably exerts a force on the compensating plate in the securing position.

The top part of the hook element preferably comprises a manipulating element by which the hook element can be switched between the releasing position and the securing position.

The manipulating element especially is manually operable by the operator of the hot foil stamping press. E.g., the manipulating element can be a knob, a grip, a handle or a recess.

Preferably, the manipulating element is a recess which is operable by a single finger of the operator. Accordingly, in this alternative, the operator needs only one hand for manipulating the hook element such that the operator at the same time can handle the compensating plate.

In one variant, the door of the platen press comprises a first door section and a second door section being arranged at an angle relative to the first door section. Such a design of the door of the platen press allows for optimization of the space requirement of the overall hot foil stamping press.

Especially, the first and second door sections can be arranged such that they encompass, i.e. essentially fold around, parts of the platen press like bobbins or rolls which provide foil for the hot foil stamping operation.

E.g., in the case the hot foil stamping press is a cross-foil stamping press, the first and second door section can encompass bobbins on which foil is wound which is provided to the sheets which are to be processed from a direction perpendicular to a feeding direction of the sheets.

To avoid that the hook element interferes with additional parts of the platen press, the base part of the hook element can be essentially parallel to the first door section or the second door section.

In one variant, the compensating plate is arranged at an angle between 0° and 90° relative to the first door section, preferably at angle between 0° and 40°.

Preferably, opposite to the hook element along a width direction of the door, a second hook element is rotatably attached to the door of the platen press, wherein the second hook element comprises a second base part and a second top part being arranged at an angle relative to the second base part. The second base part of the second hook element is rotatably attached to the door by a second fixation axle for switching between a releasing position and a securing position.

The second hook element allows a further increased stabilization of the compensating plate in the makeready position. Further, in case the compensating plate is made of a flexible material, the second hook element can prevent warping and/or tilting of the compensating plate when being held in the makeready position by the hook elements. Thus, mechanical stress on the compensating plate can be reduced, thereby minimizing the risk of damaging the compensating plate during set-up of the platen press.

Although the second hook element also has a second base part and a second top part like the hook element, the second hook element is not necessarily identical to the hook element.

To facilitate operation of the hook element and the second hook element, the hook element and the second hook element can be connected by a connection element such that the second hook element is in the releasing position when the hook element is in the releasing position and the second hook element is in the securing position when the hook element is in the securing position.

With other words, the hook element and the second hook element undergo a coupled motion when switching between their respective releasing positions and securing positions. Further, only the hook element or the second hook element need to be manipulated by the operator of the hot foil stamping press when the compensating plate needs to be secured in its makeready position. This allows the operator to reliably secure the compensating plate with a single hand while the other hand can e.g. hold the compensating plate in the desired position.

In a variant, the connection element is a bar rotatably connected at a first end to the base part of the hook element and rotatably connected at a second end to the second base part of the second hook element.

The hook element and the second hook element can rotate into opposite directions when switching from their respective releasing position to their respective securing position.

Such a kind of opposite motion can be realized by connecting the connection element on different sides of the respective fixation axles of the hook element and the second hook element.

Further advantages and features will become apparent from the following description of the invention and from the appended figures which show non-limiting exemplary embodiments of the invention and in which:

FIG. 1 schematically shows a hot foil stamping press according to the invention;

Figure 2:
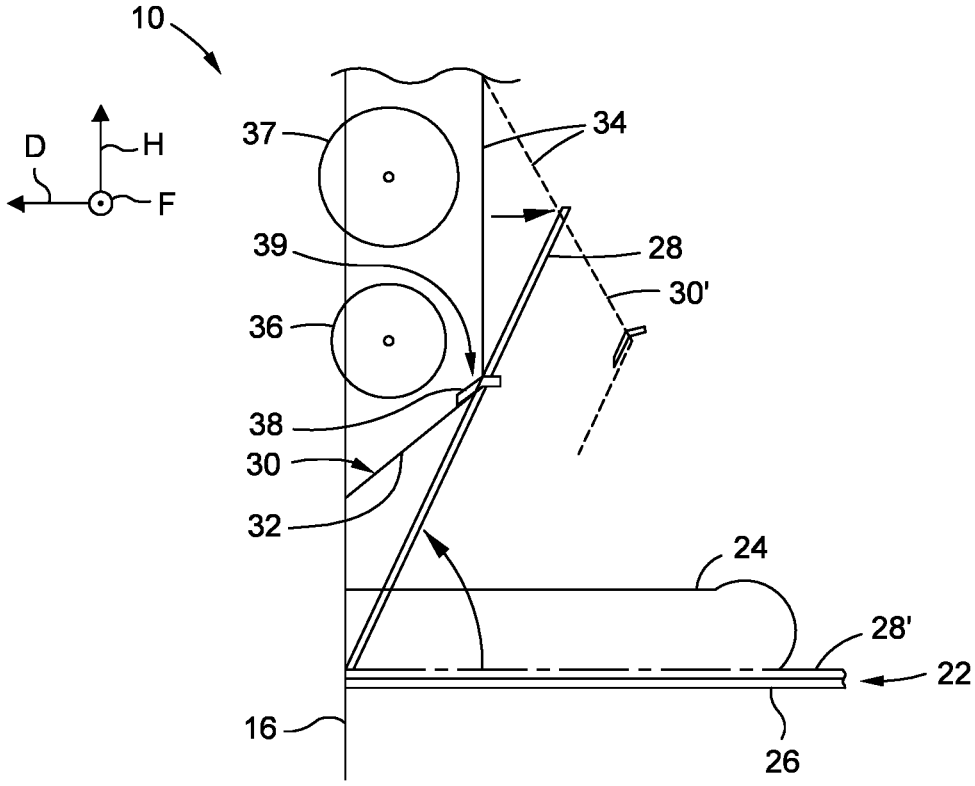
FIG. 2 shows a cut through selected parts of a platen press of the hot foil stamping press of FIG. 1.
Figure 4:
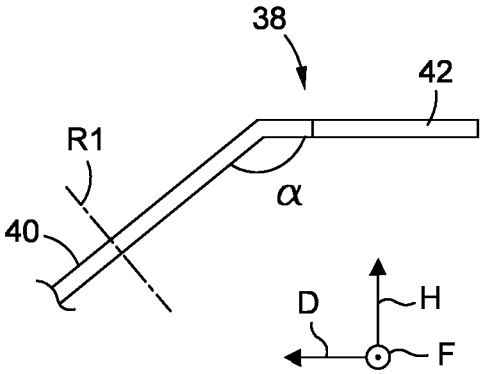
FIG. 4 shows a side view of a hook element of the hot foil stamping press of FIG. 1.
Figure 8:
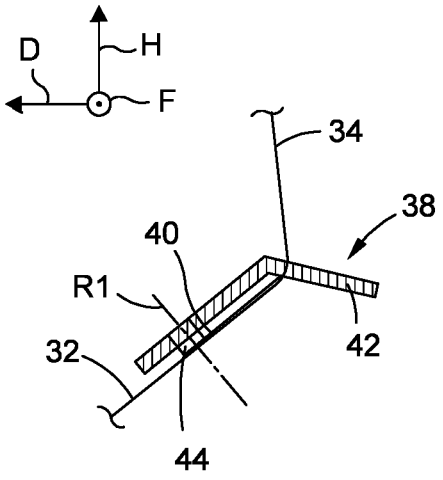
Figure 9:
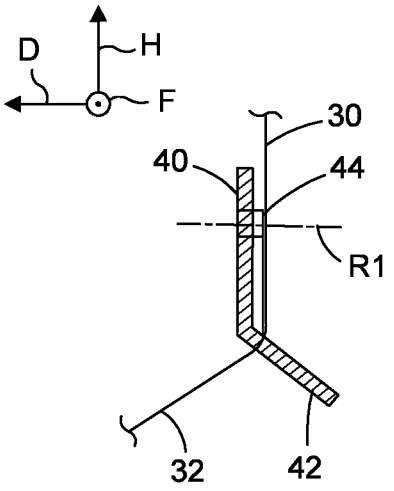

FIG. 8 schematically shows an arrangement of the hook element of FIG. 4 relative to the platen press of FIG. 2; and FIG. 9 schematically shows an alternative arrangement of the hook element of FIG. 4.

Figure 1:
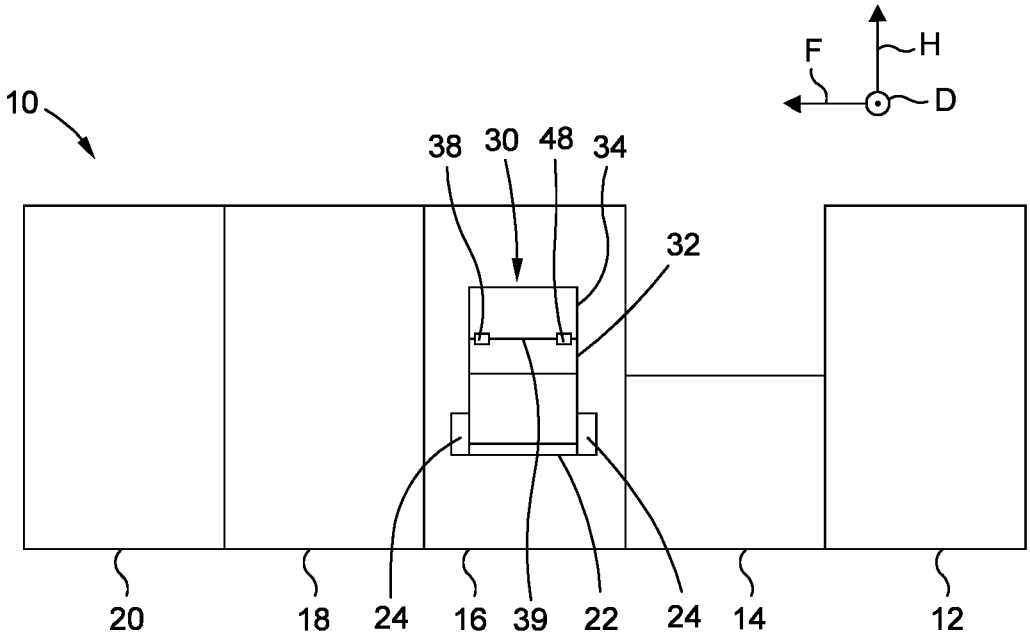

FIG. 1 schematically shows a hot foil stamping press 10 comprising a series of processing stations that are juxtaposed but interdependent on each other and form a unitary assembly.

The hot foil stamping press 10 includes, along a feeding direction F, a loading station 12 for loading sheets into the hot foil stamping press 10, followed by an inspection table 14, a platen press 16, a foil feed module 18 and an evacuation station 20 for collecting and removing the processed sheets from the hot foil stamping press 10.

It will be apparent by the person skilled in the art that the kind and arrangement of the processing stations of the hot foil stamping press 10 can differ from the one shown in FIG. 1 depending on the type of operations to be performed with the sheets, as known in the art.

The sheets to be processed by the hot foil stamping press 10 can be cardboard or paper onto which metallized plastic foil or a thin metal foil is applied in the platen press 16.

In the shown embodiment, the hot foil stamping press 10 is a cross-foil stamping press. Accordingly, in the platen press 16, metallized plastic foil or thin metal foil can be applied from the foil feed module 18 to the platen press 16 contrary to the feeding direction F, and/or perpendicular to the feeding direction F along a depth direction D within the platen press 16.

In FIG. 2, a cut through selected parts of the platen press 16 of the hot foil stamping press 10 is shown.

The platen press 16 comprises a supporting plate 22 which can be inserted into and extracted from the platen press 16 by a pair of guides 24.

The supporting plate 22 has a lower base plate 26 and a compensating plate 28 rotatably attached to the base plate 26.

The compensating plate 28 can be switched between an operating position, in which the compensating plate is essentially parallel to the base plate 26 (shown in FIG. 2 as compensating plate 28' with dashed lines), to a makeready position as indicated by the arrow in FIG. 2.

In the makeready position, a makeready sheet (not shown) can be placed by an operator of the hot foil stamping press on the base plate 26. The makeready sheet is used to toggle and/or set up the pressure achieved by the platen press 16 during the hot foil stamping process, especially by equalizing the thickness of the supporting plate 22.

The platen press 16 has a door 30 comprising a first door section 32 and a second door section 34, wherein the second door section 34 is arranged at an angle relative to the first door section 32.

The door 30, in a closing position, encompasses several bobbins 36 and 37 on which metallic foil is wound, which can be applied on the sheets to be processed by the hot foil stamping press 10.

The door 30 can be opened into an access position as indicated by the dashed representation of the door 30' in FIG. 2. In the access position, the operator has access to the inner of the platen press 16, e.g. to install and/or remove the bobbins 36 and 37.

Due to the design of the door 30 and its orientation relative to the supporting plate 22 when extracted from the platen press 16, the door 30 limits the range of motion of the compensating plate 28.

Therefore, it is not possible that the compensating plate 28 can be arranged vertically along a height direction H when installing the makeready. However, due to space restrictions on the operator side of the hot foil stamping press 10, i.e. the side shown depicted on the right hand side of FIG. 2, it is undesirable to extract the supporting plate 22 even further from the platen press 16.

Therefore, the hot foil stamping press 10 comprises a hook element 38.

The hook element 38 has a base part 40 and a top part 42 being arranged at an angle $\alpha$ relative to the base part 40 (see FIG. 4).

The hook element 38 is arranged close to an edge 39 connecting the first door section 32 and the second door section 34.

The hook element 38 is connected to the door 30 by means of a fixation axle 44 (see FIG. 8).

In FIG. 2, the hook element 38 is shown in a securing position in which the hook element 38 retains the compensating plate 28 in its makeready position.

Generally, the hook element 38 can be switched between the securing position shown in FIG. 2 and a releasing position in which the hook element 38 does not retain the compensating plate 28.

Figure 5:
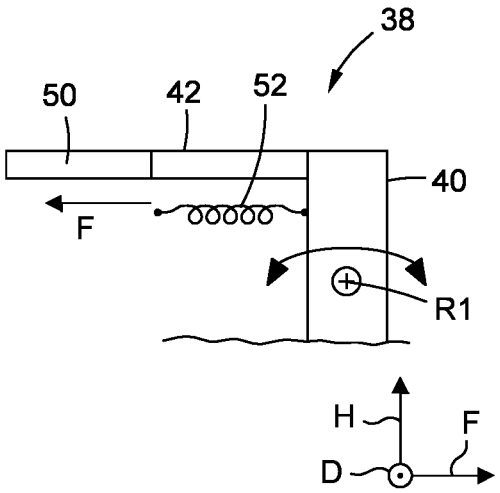
FIG. 5 shows a back view of the hook element of FIG. 4.
Figure 6:
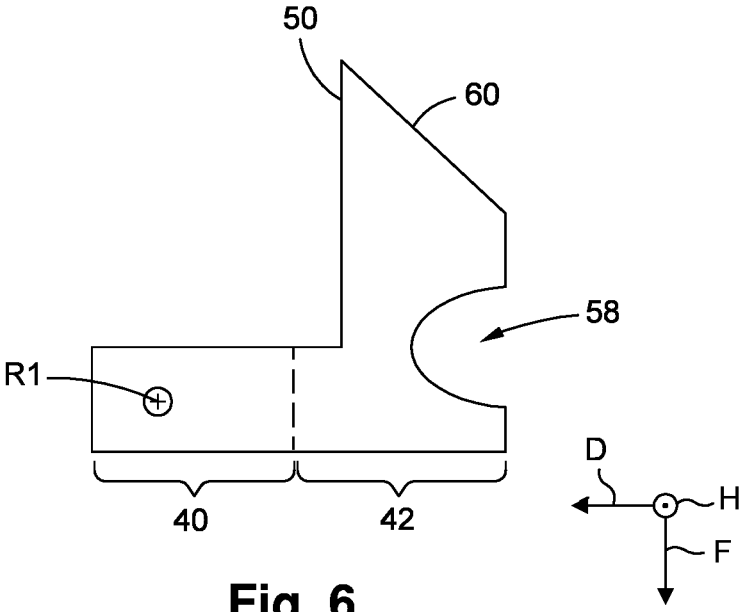
FIG. 6 shows a top view of the hook element of FIG. 4.

To this end, the hook element 38 is rotatable around a rotation axis $R_1$ (see FIGS. 4 to 6). Accordingly, the hook element 38 is rotatably connected to the door 30.

Figure 3:
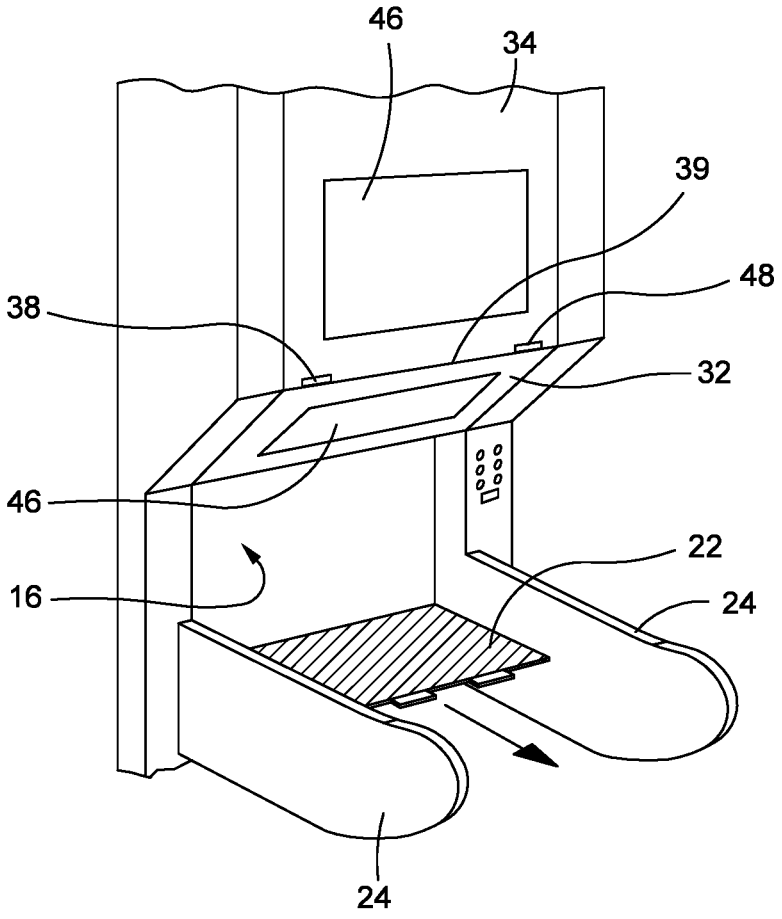
FIG. 3 shows a schematic front view of the platen press of FIG. 2.

FIG. 3 shows a schematic front view of the platen press of FIG. 2 in which the different parts of the platen press 16 are depicted in a folded manner.

In the depiction of FIG. 3, the supporting plate 22 is currently being extracted from the platen press 16 as indicated by an arrow.

Further, it becomes evident that both the first door section 32 and the second door section 34 each comprise a respective window 46 which allows inspection of the interior of the platen press 16 during operation.

Further, in the perspective used in FIGS. 1 and 3, it can be seen that the platen press 16 additionally comprises a second hook element 48 which is arranged opposite to the hook element 38 along the width of the door 30 and essentially at the same height along the height direction H. Specifically, the hook element 38 and the second hook element 48 are positioned close to the edge 39 connecting the first door section 32 and the second door section 34.

Accordingly, the compensating plate 28 is held from both sides in its makeready position by means of the hook element 38 and the second hook element 48, such that warping or bending of the compensating plate 28 can be prevented, thereby minimizing mechanical stress on the compensating plate 28.

In FIG. 4, a side view of the hook element 38 is shown, in which the angled orientation between the base part 40 and the top part 42 is easily perceived.

In the shown embodiment, the angle $\alpha$ between the base part 40 and the top part 42 is approximately 35°. Generally, the angle $\alpha$ can be in the range between 0° and 90°. Preferably, the angle $\alpha$ is in the range of from 20° to 70°.

The hook element 38 is rotatable around the rotation axis $R_1$ as indicated by the double-arrow in FIG. 5 which shows a back view of the hook element 38.

In the orientation shown in FIGS. 4 to 6, the hook element 38 is in its securing position, i.e. the compensating plate 28 would be held by a contact surface 50 of the hook element 38.

In the releasing position, the hook element 38 e.g. would be rotated by 90° clockwise, based on the viewing direction used in FIG. 5.

Additionally, in the shown embodiment, the hook element 38 comprises an elastic element 52 which is a spring exerting a force F indicated in FIG. 5.

The elastic element 52 holds the hook element 38 in its securing position.

FIG. 6 is a top view on the hook element 38 in which a manipulating element 58 of the hook element 38 can be seen.

The manipulating element 58 is used by the operator of the hot foil stamping press 10 for switching between the releasing position and the securing position of the hook element 38.

In the shown embodiment, the manipulating element 58 is a recess in which a single finger of the operator can engage for controlling the hook element 38. Generally, the manipulating element 58 could be designed differently, e.g. the manipulating element 58 could be a handle, bar or knob.

Additionally, the top part 42 of the hook element 38 has a sloped funnel surface 60.

Figure 7:
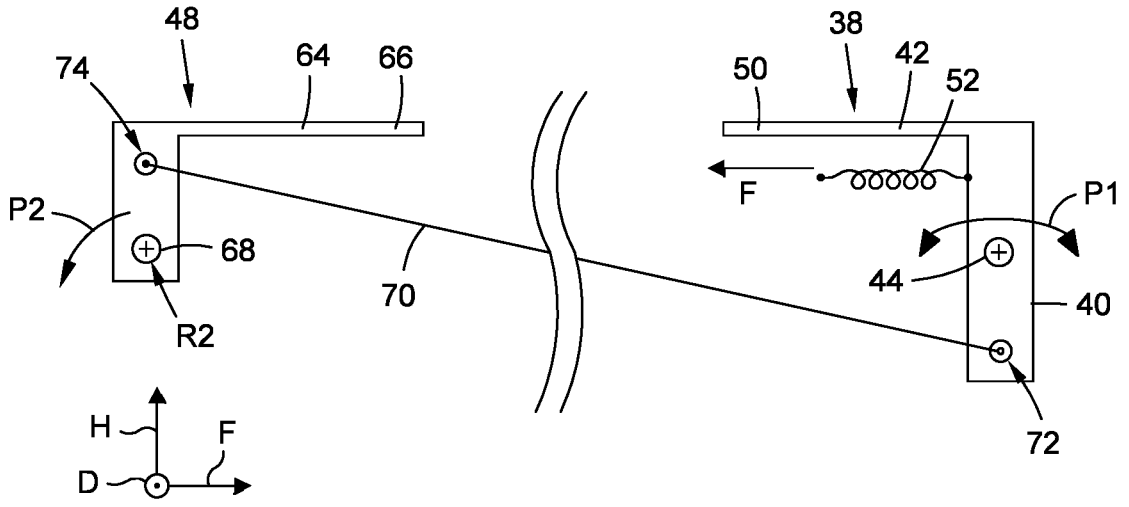
FIG. 7 shows a back view of the hook element of FIG. 5 together with a second hook element of the hot foil stamping press of FIG. 1.

In FIG. 7, the interaction between the hook element 38 and the second hook element 48 is illustrated.

The second hook element 48 comprises a second base part 62 and a second top part 64 which is arranged at an angle to the second base part 62 and a contact surface 66, too, analogously to the hook element 38.

Further, the second hook element 48 is rotatably connected by a second fixation axle 68 to the door 30.

Though the hook element 38 and the second element hook element 48 have an analog structure, as can be seen in FIG. 7, the hook element 38 and the second hook element 48 do not need to be structurally identical to each other.

The hook element 38 and the second hook element 38 are connected by a connection element 70 which in the shown embodiment is a rigid bar.

The bar is rotatably connected with a first end 72 to the second base part 40 of the hook element 38 and with a second end 74 to the second base part 62 of the second hook element 48.

However, the first end 72 and the second end 74 are connected at opposite sides of the respective fixation axles 44 and 68 of the hook element 38 and the second hook element 48 along the height direction H.

Therefore, when the hook element 38 is switched from the securing position into the releasing position by a rotation around the rotation axis $R_1$, shown in FIG. 7 by a clockwise rotation as indicated by arrow $P_1$, the second hook element 48 is also switched from the securing position into the releasing position, but by a rotation around a rotation axis $R_2$ in opposite direction, shown in FIG. 7 by a counterclockwise rotation as indicated by arrow $P_2$.

Therefore, only the hook element 38 needs to be manipulated for securing the compensating plate 28 in its makeready position by both the hook element 38 and the second hook element 48.

Further, it is sufficient that the hook element 38 is held in its securing position by the elastic element 52.

Therefore, the hot foil stamping press 10 according to the invention provides a simple, easy to use and reliable mechanism for securing the compensating plate 28 during preparation of the supporting plate 22, thereby reducing the necessary space and set-up time of the hot foil stamping press 10.

FIG. 8 shows a schematic arrangement of the hook element 38 relative to the door 30 of the platen press 16.

The second base part of the hook element 38 is essentially parallel to the first door section 32 of the door 30 of the platen press 16.

The fixation axle 44 rotatably connects the hook element 38 to the first door section 32.

In FIG. 9, an alternative arrangement of the hook element 38 relative to the door 30 of the platen press 16 is shown.

In this alternative, the second base part 40 of the hook element 38 is essentially parallel to the second door section of the door 30 of the platen press 16 and the fixation axle 44 rotatably connects the hook element 38 to the second door section.

Both in the arrangements shown in FIG. 8 and FIG. 9, the hook element 38 only needs minimal amounts of space on the side of the door 30 facing the inner of the platen press 16. Which of the arrangements is used can therefore be chosen based on the further parts of the platen press, e.g. based on the position of the bobbins 36 and 37 (see FIG. 2).

The invention claimed is:

1. A hot foil stamping press comprising a platen press, with a supporting plate comprising a base plate and a compensating plate being rotatably attached to the base plate for switching between an operating position and a makeready position, and a hook element comprising a base part and a top part being arranged at an angle relative to the base part, wherein the hook element is rotatably attached to a door of the platen press by a fixation axle for switching between a releasing position and a securing position of the hook element, wherein the top part retains the compensating plate in a makeready position when the hook element is in a securing position.

2. The hot foil stamping press according to claim 1, wherein the hook element is held in the securing position by an elastic element.

3. The hot foil stamping press according to claim 1, wherein the top part of the hook element comprises a manipulating element by which the hook element can be switched between the releasing position and the securing position.

4. The hot foil stamping press according to claim 1, wherein the door of the platen press comprises a first door section and a second door section being arranged at an angle relative to the first door section.

5. The hot foil stamping press according to claim 4, wherein the base part of the hook element is essentially parallel to the first door section or to the second door section.

6. The hot foil stamping press according to claim 4, wherein the compensating plate is at an angle between 0° and 180° to the first door section in the makeready position.

7. The hot foil stamping press according to claim 1, wherein opposite to the hook element along a width direction of the door a second hook element is rotatably attached to the door of the platen press, wherein the second hook element comprises a second base part and a second top part being arranged at an angle relative to the second base part, and wherein the second base part of the second hook element is rotatably attached to the door by a second fixation axle for switching between a releasing position and a securing position of the second hook element.

8. The hot foil stamping press according to claim 7, wherein the hook element and the second hook element are connected by a connection element such that the second hook element is in the releasing position when the hook element is in the releasing position and the second hook element is in the securing position when the hook element is in the securing position.

9. The hot foil stamping press according to claim 8, wherein the connection element is a bar rotatably connected at a first end to the base part of the hook element and rotatably connected at a second end to the second base part of the second hook element.

10. The hot foil stamping press according to claim 7, wherein the hook element and the second hook element rotate into opposite directions when switching from their respective releasing position to their respective securing position.

* * * * *